US012005307B1

(12) United States Patent
Maresh et al.

(10) Patent No.: US 12,005,307 B1
(45) Date of Patent: Jun. 11, 2024

(54) CLIMBING EXERCISE APPARATUS

(71) Applicants: Joseph D Maresh, West Linn, OR (US); Kenneth W Stearns, Houston, TX (US)

(72) Inventors: Joseph D Maresh, West Linn, OR (US); Kenneth W Stearns, Houston, TX (US)

( * ) Notice: Subject to any disclaimer, the term of this patent is extended or adjusted under 35 U.S.C. 154(b) by 0 days.

(21) Appl. No.: 17/300,948

(22) Filed: Dec. 17, 2021

Related U.S. Application Data

(60) Provisional application No. 63/205,492, filed on Dec. 15, 2020.

(51) Int. Cl.

| | |
|---|---|
| ***A63B 22/20*** | (2006.01) |
| ***A63B 21/00*** | (2006.01) |
| ***A63B 21/012*** | (2006.01) |
| ***A63B 22/00*** | (2006.01) |

(52) U.S. Cl.
CPC ..... *A63B 22/205* (2013.01); *A63B 21/00192* (2013.01); *A63B 21/012* (2013.01); *A63B 21/154* (2013.01); *A63B 22/0005* (2015.10); *A63B 22/001* (2013.01)

(58) Field of Classification Search
CPC ..... A63B 21/00058; A63B 21/00061; A63B 21/00065; A63B 21/00069; A63B 21/00072; A63B 21/00178; A63B 21/00181; A63B 21/02; A63B 21/021; A63B 21/04; A63B 21/0407; A63B 21/0428; A63B 21/0442; A63B 21/0609; A63B 21/062; A63B 21/151; A63B 21/154; A63B 21/4033; A63B 21/4034; A63B 21/4035; A63B 21/4041; A63B 21/4045; A63B 22/0048; A63B 22/0056; A63B 22/0058; A63B 22/0061; A63B 22/0064; A63B 22/0066; A63B 22/0069; A63B 2022/0051; A63B 2022/0071; A63B 2022/0074
See application file for complete search history.

(56) References Cited

U.S. PATENT DOCUMENTS

| | | | | |
|---|---|---|---|---|
| 3,363,335 | A * | 1/1968 | Burhns | A61H 1/02 601/40 |
| 5,040,785 | A * | 8/1991 | Charnitski | A63B 23/0417 482/52 |
| 5,492,515 | A * | 2/1996 | Charnitski | A63B 22/205 482/37 |
| 10,758,776 | B2 * | 9/2020 | Chen | A63B 71/0054 |
| 11,077,336 | B2 * | 8/2021 | Carruthers | A63B 21/4035 |
| 11,167,163 | B2 * | 11/2021 | Chin | A63B 22/0046 |
| 2016/0059060 | A1 * | 3/2016 | Lagree | A63B 21/023 482/92 |

* cited by examiner

*Primary Examiner* — Zachary T Moore
(74) *Attorney, Agent, or Firm* — Nick A Nichols, Jr.

(57) ABSTRACT

A climbing exercise apparatus having ipsilateral and contralateral modes of operation may include a frame supporting generally vertically oriented frame members in spaced apart relationship to one another fixedly secured to a base of the frame. The vertically oriented members may support endless belt and pulley systems. Handlebars and foot supports may be connected to upper and lower carriage members engaging the endless belt to establish ipsilateral and contralateral configurations of the climbing exercise apparatus.

11 Claims, 8 Drawing Sheets

CLIMBING EXERCISE APPARATUS

CROSS-REFERENCE TO RELATED APPLICATION

This application claims priority to and the benefit of the filing date of U.S. Provisional Application Ser. No. 63/205,492, filed Dec. 15, 2020, which application is herein incorporated by reference in its entirety.

BACKGROUND

The present invention relates to fitness equipment of a category referred to as "climbing machines" or "stepping machines" where the foot exercise paths are substantially vertical.

During use of a climbing exercise machine, two coordinated body movements are generally possible. A first motion may be referred to as ipsilateral movement where unison movement of the upper limb and the lower limb occur on the same side of a user, and a second motion referred to as contralateral movement where the upper limb and lower limb on the same side of a user move in opposite directions. The first motion of ipsilateral movement or straight climbing is more closely correlated with martial arts where martial arts typically employ ipsilateral movements, whereas the second motion of asymmetrical or cross climbing action is more closely correlated with oppositional exercises such as swimming and walking. In ipsilateral motion the body halves do not cooperate but move separately, and in contralateral motion both sides of the brain function at the same time in a coordinated manner.

SUMMARY

A climbing exercise apparatus having ipsilateral and contralateral modes of operation may include a frame supporting generally vertically oriented frame members in spaced apart relationship to one another fixedly secured to a base of the frame. The vertically oriented members may support endless belt and pulley systems. Handlebars and foot supports may be connected to upper and lower carriage members engaging the endless belt to establish ipsilateral and contralateral configurations of the climbing exercise apparatus.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
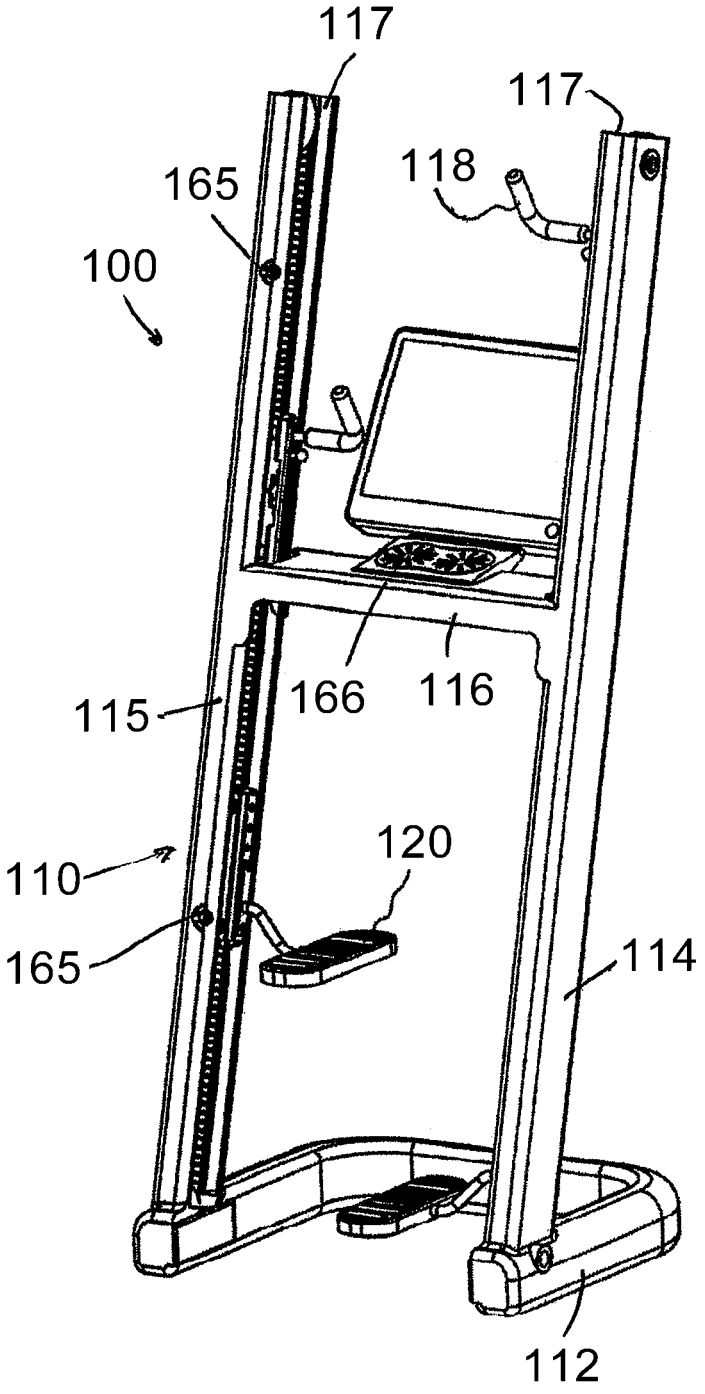
FIG. 1 is perspective view of a climbing exercise apparatus.

Referring first to FIG. 1, a first embodiment of a climbing exercise apparatus is generally identified by the reference numeral 100. The exercise apparatus 100 may include a frame 110 comprising a base 112 and stanchions 114 and 115 fixedly secured to the base 112. The stanchions 114, 115 may extend generally vertically upward form the base 112 and are laterally spaced apart from one another. The stanchions 114, 115 may be connected by a transverse frame member 116 at about the midpoint thereof. The stanchions 114, 115 may define longitudinal channels 117 in spaced apart facing relationship to one another.

Figure 2B:
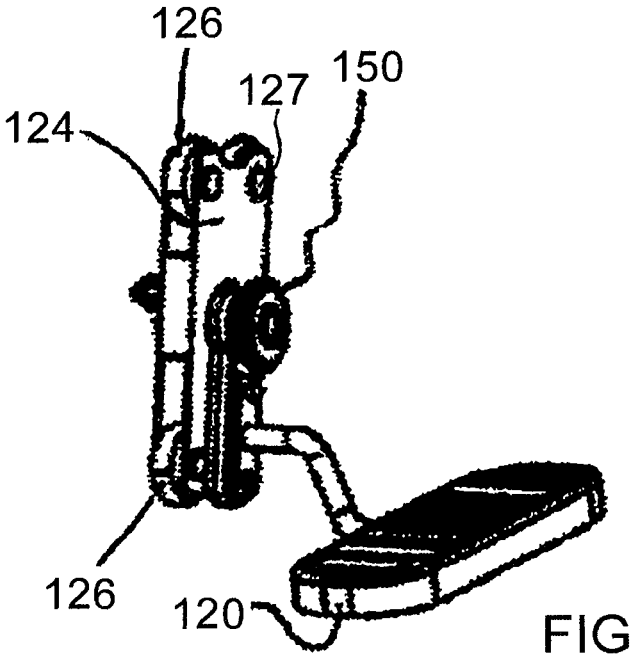
FIG. 2B is a perspective view of an alternate embodiment of a foot support carriage member for the climbing exercise apparatus shown in FIG. 1.
Figure 2A:
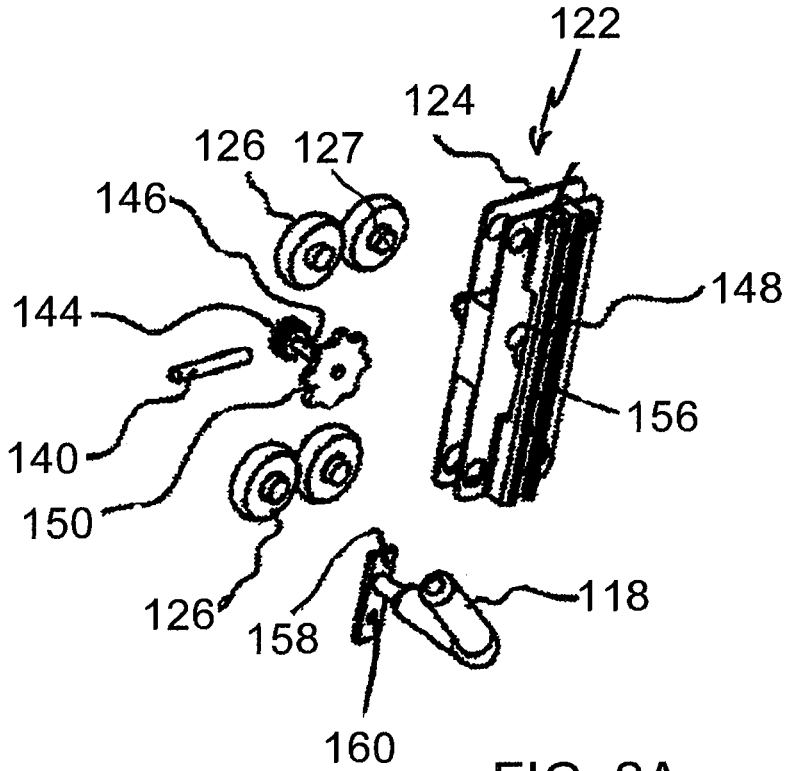
FIG. 2A is an exploded perspective view of a carriage member of the climbing exercise apparatus shown in FIG. 1.

Handlebars 118 and foot platforms 120 may be connected to upper and lower carriage members 122, respectively. The carriage members 122 may be constrained to move along the channels 117 of the stanchions 114, 115. A carriage member 122, shown in the exploded view of FIG. 2A, is described herein. It is understood however that all carriage members 122 are structurally the same. Carriage members 122 may include a carriage chassis 124. A plurality of rollers 126 may be rotatably secured to the carriage chassis 124 at axle shafts 127. Handlebars 118 may be secured to the upper carriage members 122. The handlebars 118 may be adjustable along the carriage members 122 to accommodate different heights and reach of users. The foot platforms 120 may be secured to the lower carriage members 122.

Figure 3:
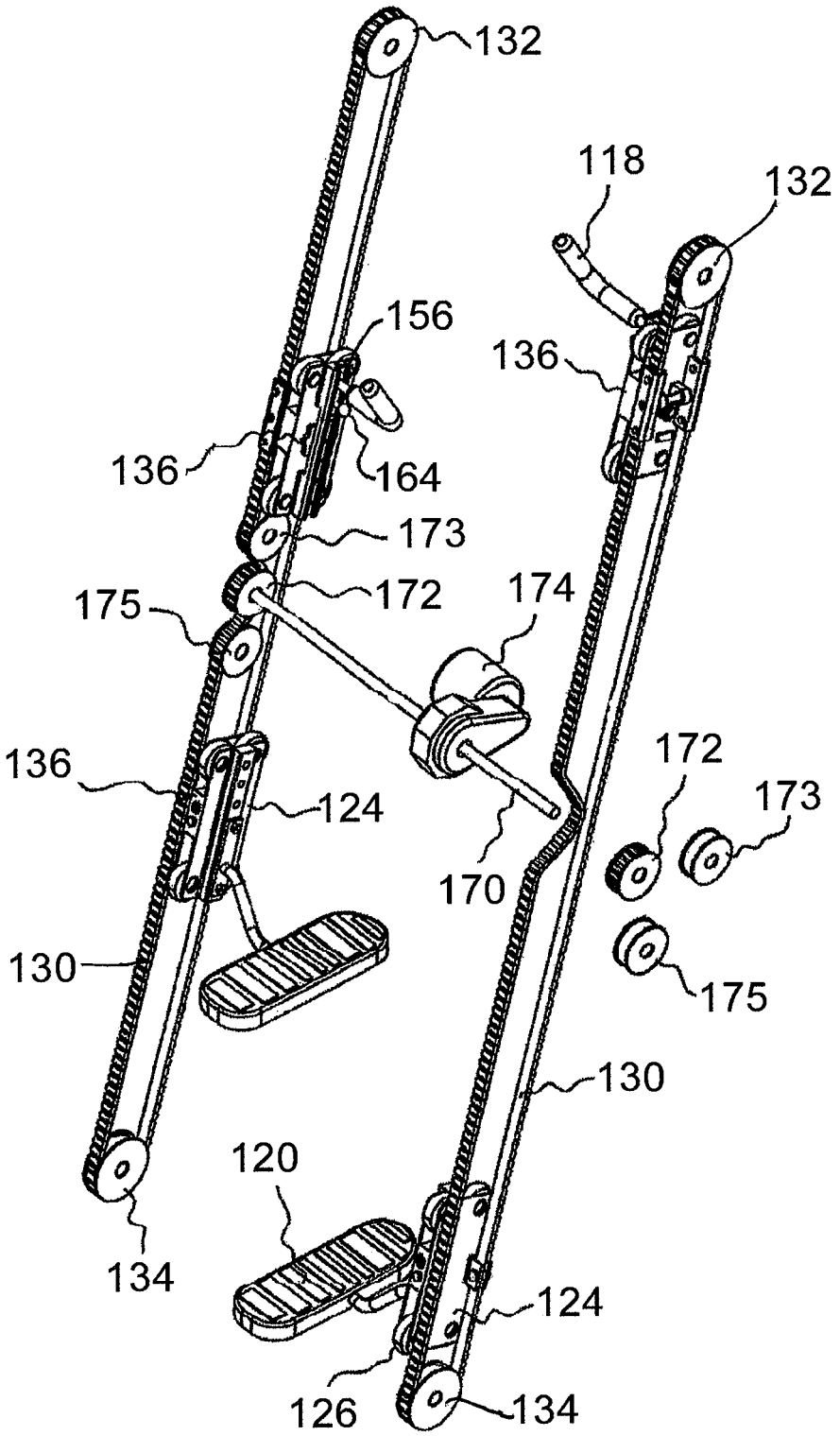
FIG. 3 is a perspective view of the carriage pulley system without supporting structure of the climbing exercise apparatus shown in FIG. 1.

Referring now to FIG. 3, an endless belt 130 may be routed about a top pulley 132 and a bottom pulley 134. The top pulley 132 and bottom pulley 134 may be rotatably secured in the channels 117 proximate the upper and lower ends of the stanchions 114, respectively. The handlebars 118 and foot platforms 120 may be connected to a front or rear span of the belt 130.

Figure 4A:
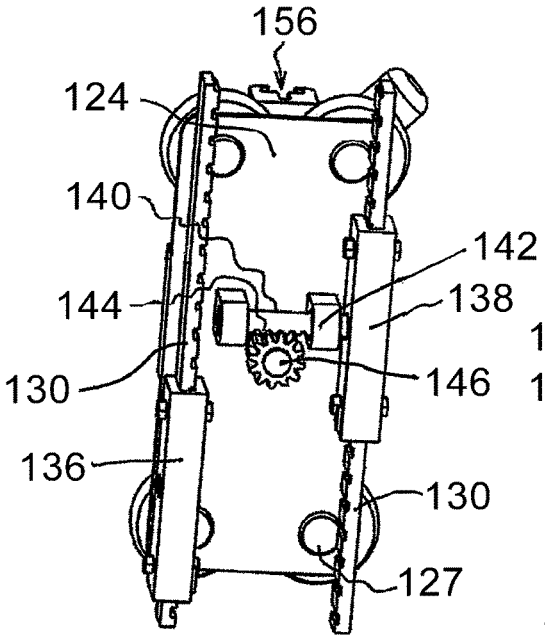
FIG. 4A is a back perspective view of a carriage member of the climbing exercise apparatus shown in FIG. 1.
Figure 4B:
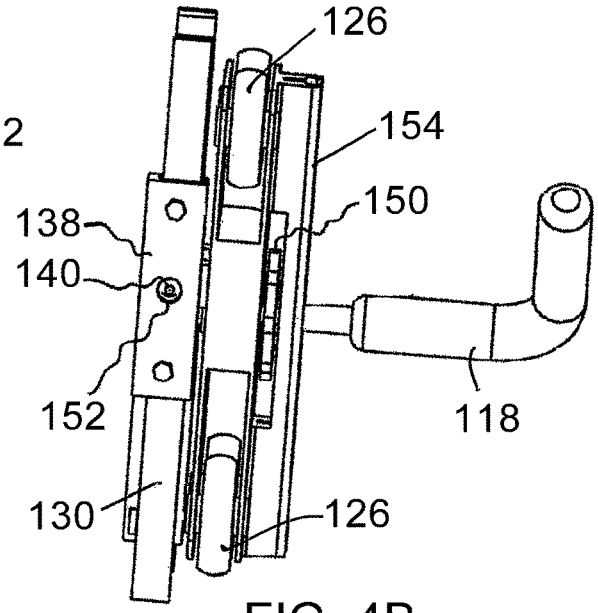
FIG. 4B is a side view of a carriage member of the climbing exercise apparatus shown in FIG. 1.
Figure 4C:
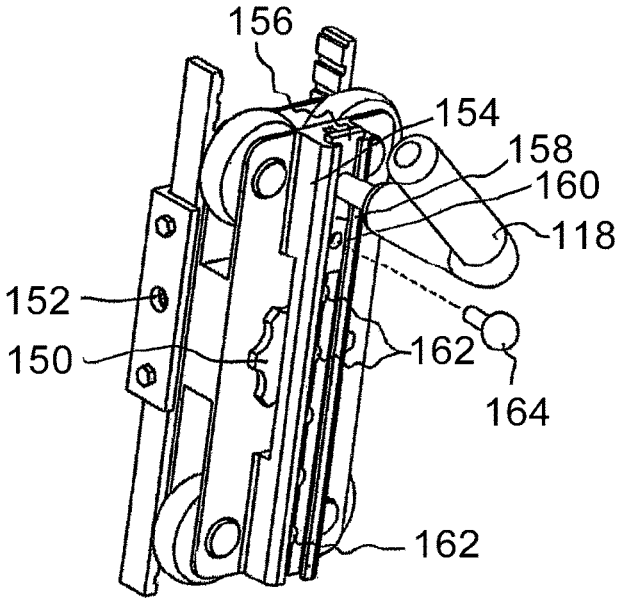
FIG. 4C is a front perspective view of a carriage member of the climbing exercise apparatus shown in FIG. 1 depicting an adjustment nut in explode view.
Figure 4D:
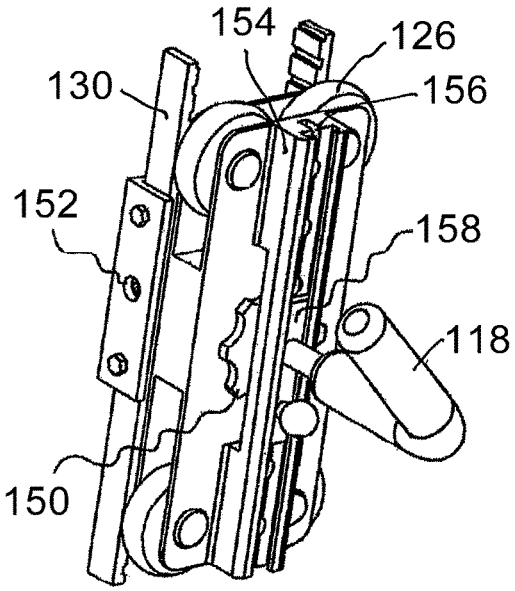
FIG. 4D is a front perspective view of the carriage member of the climbing exercise apparatus shown in FIG. 4C, illustrating adjustment of the connection point of the handlebar to the carriage member.

Referring now to FIGS. 4A 4D, a first clamp 136 and a second clamp 138 may be connected to the belt 130. The first clamp 136 may connect to a front span of the belt 130 and the second clamp 138 may connect to a rear span of the belt 130.

A rack pin 140 may be movably supported by journal hubs 142 which are fixedly secured to the carriage chassis 124. The rack pin 140 is in cooperative engagement with a pinion gear 144. The pinion gear 144 is rigidly secured to a distal end of a pinion shaft 146, best shown in FIG. 2A. The pinion shaft 146 extends through a journal opening 148 in the carriage chassis 124. A knob 150 may be fixedly secured to the opposite distal end of the pinion shaft 146. Rotation of the knob 150 moves the rack pin 140 laterally left to right so that the end of the rack pin 140 may extend into a receiving hole 152 of the first or second clamps 136, 138. Ipsilateral and contralateral configurations of the apparatus 100 may be established by the appropriate connection of the carriage members 122 to the belt 130. For example, when the upper and lower carriage members 122 are both connected to a front span of the belt 130, the apparatus 100 operates in the ipsilateral configuration. The handlebars 118 and the foot platforms 120 move up or down on the same side of the user in unison. When the upper carriage members 122 are connected to a front span of the belt 130 and the lower carriage members 122 are connected to a rear span of the belt 130, the exercise apparatus 100 operates in the contralateral configuration. The handlebars 118 and the foot platforms 120 on the same side of the user move in opposite directions relative to one another. For example, the left handlebar 118 and the left foot platform 120 move in opposite directions.

Figure 5A:
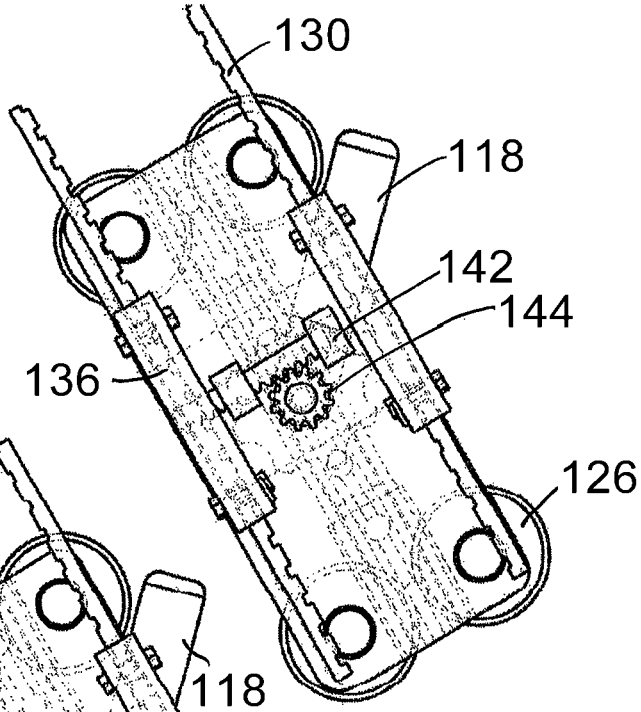
FIGS. 5A-5C are perspective views of a carriage member of the climbing exercise apparatus shown in FIG. 1, illustrating the position sequence of a rack pin engaging front and rear spans of an endless belt.
Figure 5B:
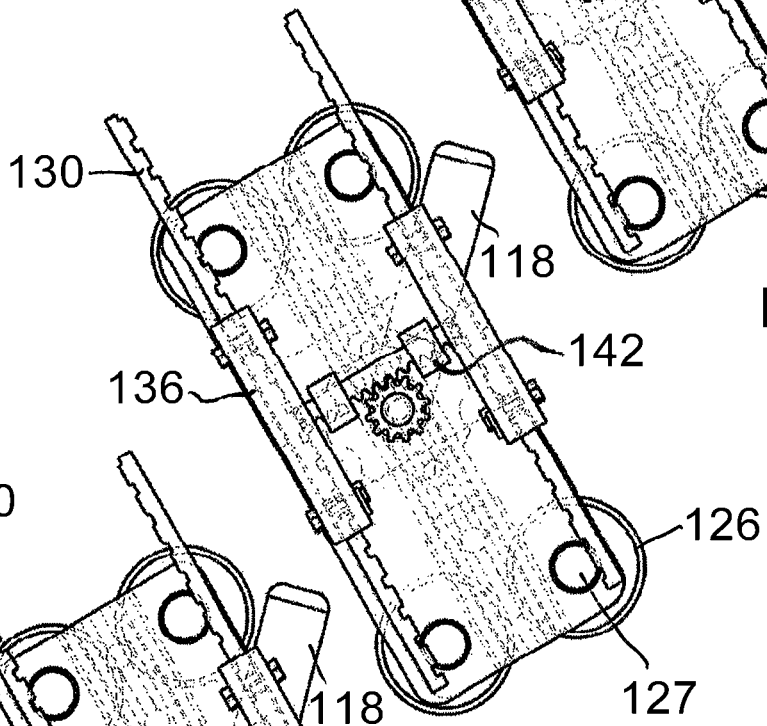
Figure 5C:
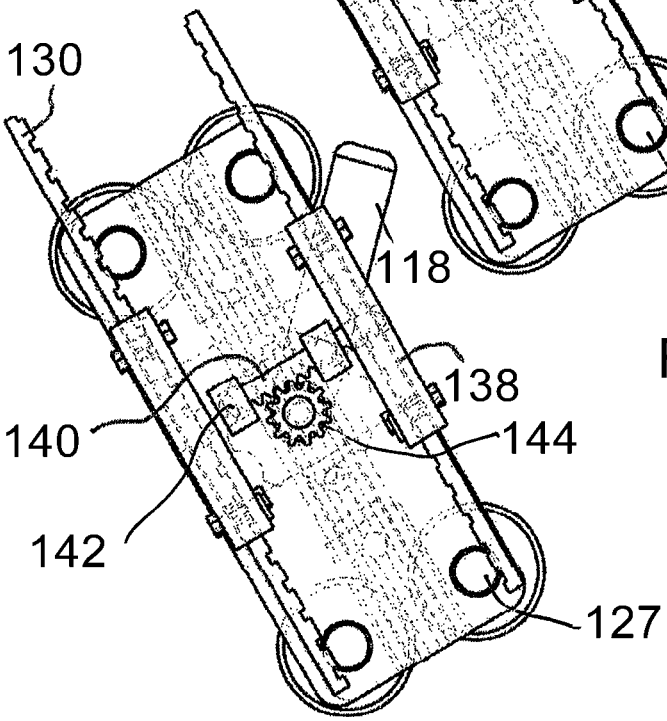
Figures 6A, 6B, 6C:
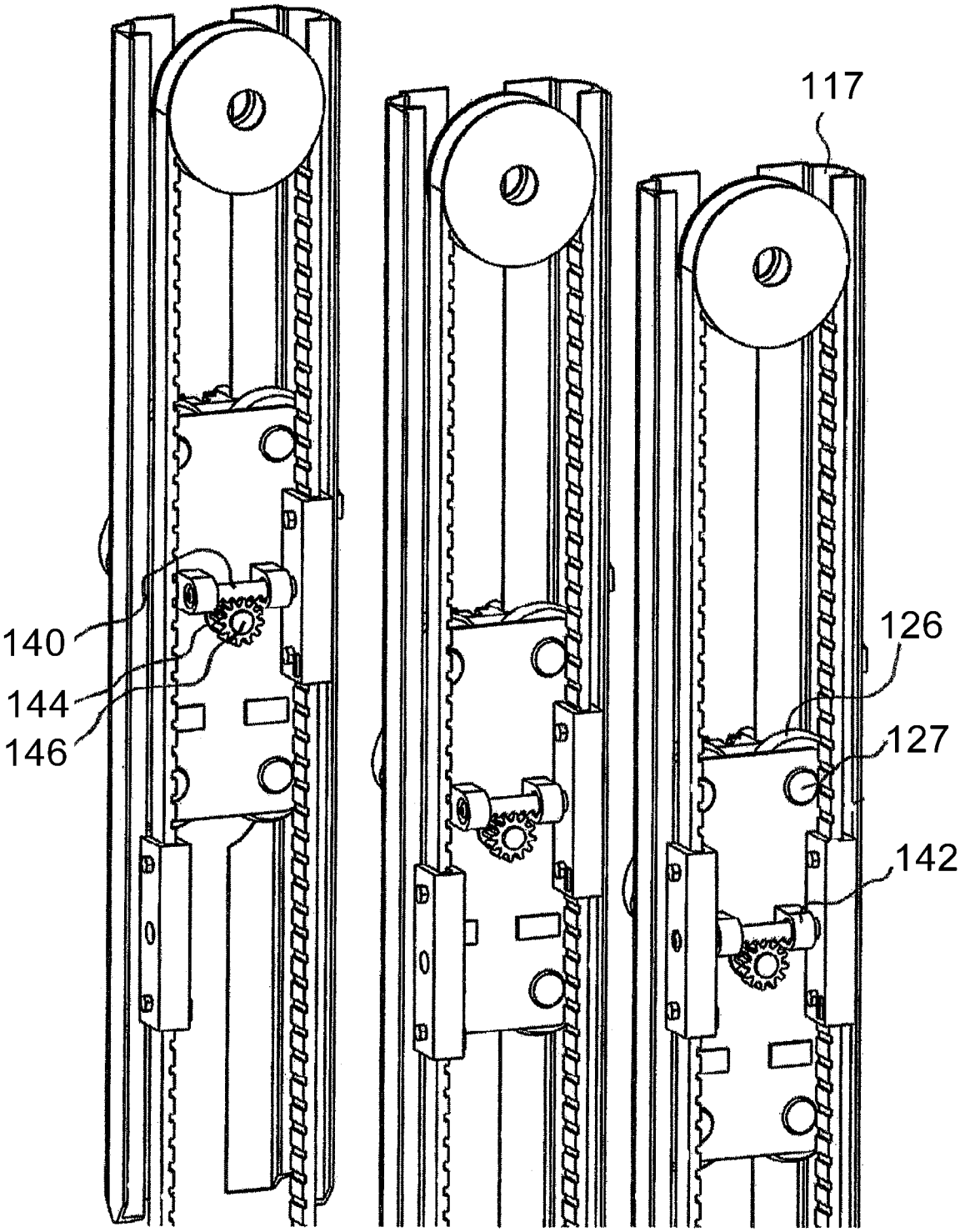
FIGS. 6A-6C are perspective views illustrating an alignment sequence of the belt clamps of the climbing exercise apparatus shown in FIG. 1.

FIGS. 5A-5C, illustrate the position of the rack pin 140 upon rotation of the knob 150 to select the mode of operation of the exercise apparatus 100. In FIG. 5A, the rack pin 140 is shown engaging the left clamp 136. In FIG. 5B, the rack pin 140 is at an intermediate position as the left and right clamps 136, 138 are aligned to switch the operation mode of the exercise apparatus 100. In FIG. 5C, the rack pin 140 is shown engaging the right clamp 138. A user may set the exercise apparatus 100 to operate in the ipsilateral or contralateral mode by selecting the appropriate connection position of the rack pin 140. In FIGS. 6A-6C the sequence of aligning the clamps 136, 138 to set the mode of operation of the exercise apparatus 100 is illustrated.

Referring again to FIGS. 4A-4D, the knob 150 is located within a void between the carriage chassis 124 and a handlebar mounting bracket 154 fixedly secured to the carriage member 122 and is conveniently accessible for a user to manually set the operational mode of the exercise apparatus 100 between ipsilateral and contralateral configurations. The mounting bracket 154 defines a longitudinal race 156 sized to receive the base 158 of the handlebar 118. The base 158 may included a hole 160 which may be aligned with one of a plurality of adjustment holes 162 formed in the mounting bracket 154. A lock pin 164 may extend through the aligned holes 160, 162 to rigidly secure the handlebar 118 to the carriage 122. It will be observed, as illustrated in FIG. 2B, that the rack and pinion gear shifting mechanism may be incorporated in the lower carriage member 122 instead of the upper carriage member 122 where rotation of the knob 150 switches the exercise apparatus 100 to operate in the ipsilateral or contralateral mode. In this configuration, the foot platform 120 may be adjusted along the mounting bracket 154 and coupled to the carriage member 122 in the manner described above with reference to the handlebar 118.

Referring again to FIG. 1, carriage position sensors 165, for example but without limitation, magnetic/inductive proximity sensor and/or optical/photo transistor and light emitting diodes and the like, may be employed to facilitate position awareness of the carriage members 122. The position sensors 165 may be secured to the upper and lower regions of the stanchions 114, 115. Powered actuation or shifting of the rack pin 140, best shown in FIG. 4A, may be performed with unillustrated electric solenoids and the like. Powered actuation may only be available when the carriage members 122 are at a home or parked position where the first and second clamps 136, 138 are directly across one another and the receiving holes 152 of the clamps 136, 138 are in alignment, illustrated in FIGS. 5A-5C. In an alternative design, a sensor may be mounted to an upper or lower carriage member 122 and connected with wires embedded in a ribbon or coiled conductor which communicate with a control panel 166 and the like. Employing sensors which also detect the movement direction of any of the carriage members 122 may also be desired where, for example, the status mode of the exercise apparatus 100 may be indicated or displayed for purposes of understanding and sequencing exercise sessions, such as when directed by an instructor in an exercise class and the like.

Referring now to FIG. 3, a transverse cross shaft 170 is rotationally coupled to the stanchions 114, 115. The cross shaft 170 provides dependent movement at the right and left of the exercise apparatus 100. Right and left timing pulleys 172 are rigidly secured proximate opposite distal ends of the cross shaft 170. The timing pulleys 172 engage the belts 130 so that movement of the belts 130 is in dependent relationship. A resistance unit 174 may be coupled the cross shaft 170, typically with a pulley or gear ratio increase. The resistance unit 174 may include mechanical friction resistance or magnetic resistance, for example but without limitation. The timing pulleys 172 may engage either the front or rear span of the belts 130.

Figure 7B:
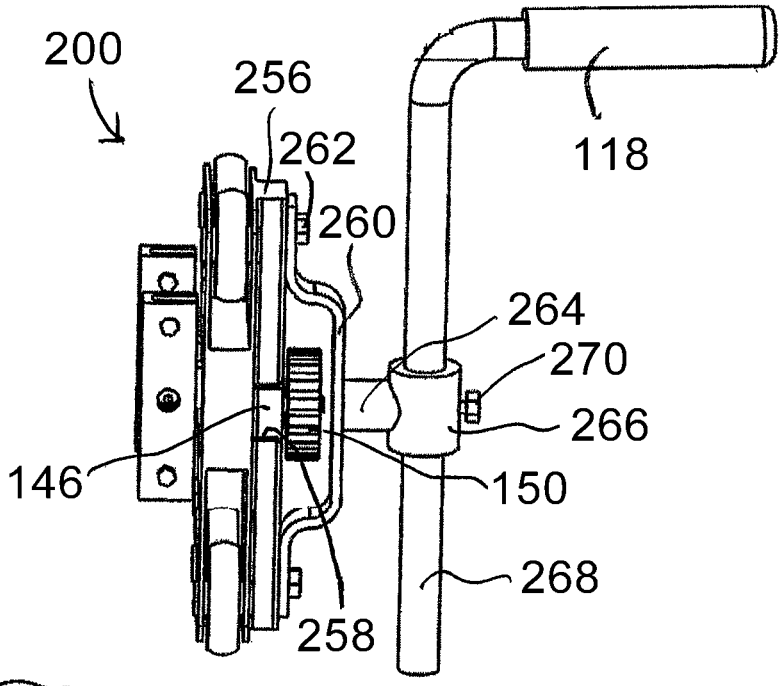
FIG. 7B is a side view of the carriage member shown in FIG. 7A.
Figure 7A:
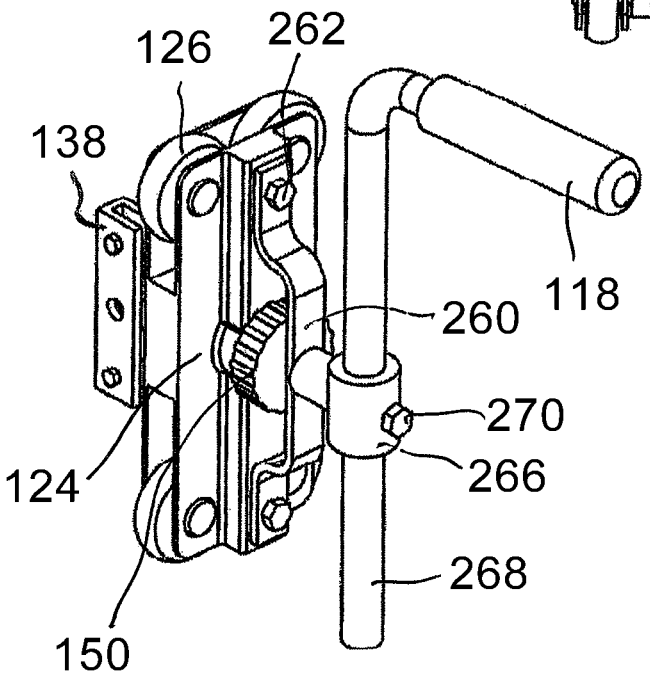
FIG. 7A is a perspective view of a second embodiment of a carriage member for a climbing exercise apparatus.

Referring now to FIGS. 7A and 7B, a second embodiment of a carriage member for a climbing exercise apparatus is generally identified by the reference numeral 200. As noted by the use of common reference numerals, the carriage member 200 is similar to carriage member 122 of the exercise apparatus 100 with the exception that handlebars 218 are adjustably connected to a mounting bracket 254 including a bracket base 256 fixedly secured to the carriage chassis 124 The bracket base 256 may be integrally formed with the carriage chassis 124 or otherwise secured to the carriage chassis 124 in a manner known in the art. The bracket base 256 may include a through hole 258 for receiving the pinion shaft 146 therethrough. The knob 150 fixedly secured to the pinion shaft 146 may be positioned in a void between the bracket base 256 and a raised portion of a bracket handle 260 which is fixed to the bracket base 256 by bolts 262. A post 264 terminating in a collar 266 projects outwardly from the bracket handle 260. A handlebar extension 268 may be received through the collar 266'. A set screw 270 may be threaded through the sidewall of the collar 266. The distal end of the set screw may engage the handlebar extension 268 securing the handlebar 218 to the carriage member 200. The handlebar 218 may be adjusted up or down relative to the carriage member 200 by loosening or tightening the set screw 270 to accommodate the height and reach of different users.

Figure 8A:
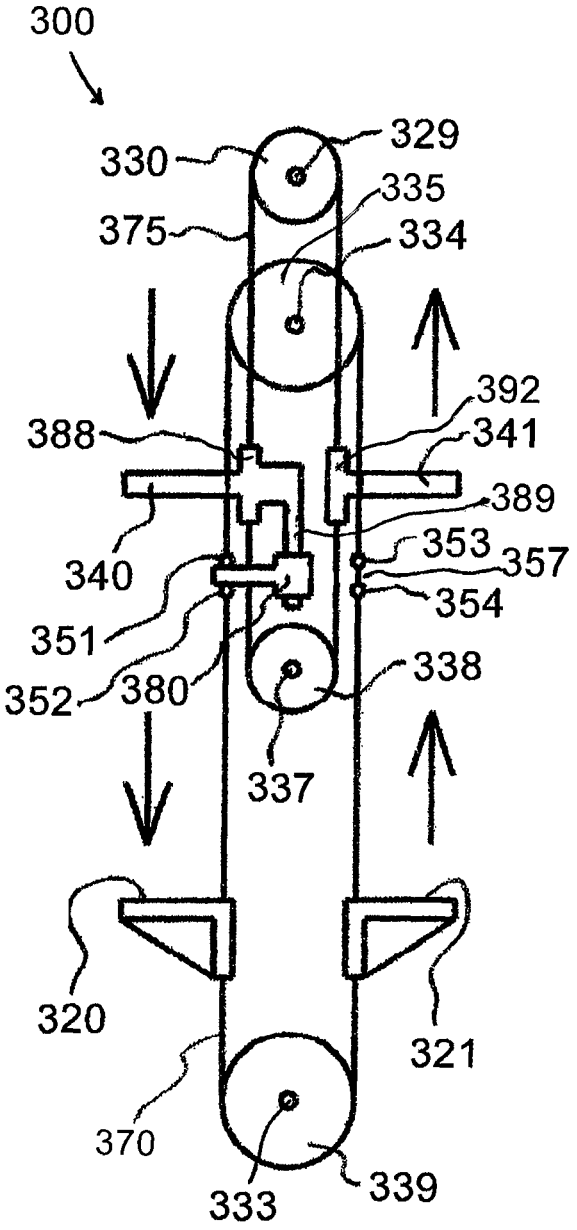
FIGS. 8A and 8B are diagrammatic views of a third embodiment of a climbing exercise apparatus depicting left and right pulley assembly configurations.
Figure 8B:
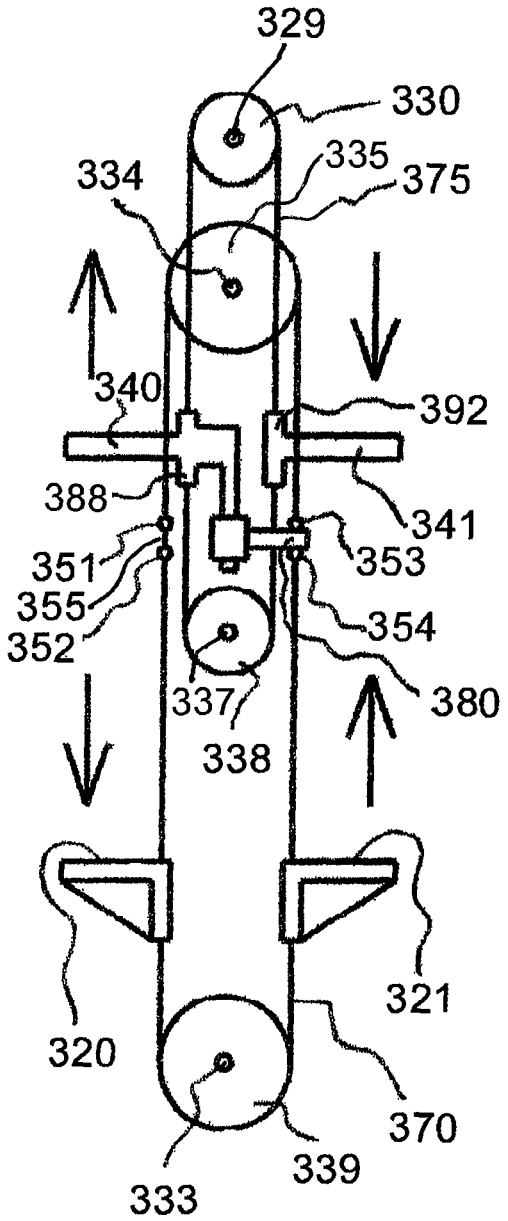

Referring now to FIG. 8A and FIG. 8B, a diagrammatic view of a third embodiment of a climbing exercise apparatus is generally identified by the reference numeral 300. A lower pulley 339 may be rotatably secured to an exercise apparatus frame (frame not illustrated) at a lower journal 333. An upper pulley 335 may be rotatably secured to the exercise apparatus frame at an upper journal 334. Endless foot cable loop 370 may be routed around the lower and upper pulleys 339 and 335, respectively. Continuing, a first hand cable loop pulley 338 may be rotatably secured to the exercise apparatus frame (the frame not illustrated) at journal 337, and a second hand cable loop pulley 330 may be rotatably secured to the exercise apparatus frame at journal 329. Endless hand cable loop 375 may be routed around the first and second hand cable loop pulleys 338 and 330, respectively.

Right hand grip 341 may be connected to right hand grip base 392, and right hand grip base 392 may be fixedly secured to a right span of hand cable loop 375 by cable crimping or other means known in the art. Similarly, left hand grip 340 may be connected to left hand grip base 388, and left hand grip base 388 may be fixedly secured to a left span of hand cable loop 375 by cable crimping or other means known in the art.

Left foot platform 320 and right foot platform 321 may be fixedly secured to left and right spans of the endless foot cable loop 370, respectively. Foot platforms 320 and 321, as well as left hand grip base 388 and right hand grip base 392 are generally linearly constrained to move along a generally upright region of the unillustrated frame in a manner known in the art. Typically such linear restraints involve rollers moving along a race, and/or slide blocks moving along a race or low friction sleeves moving along a shaft, and such linear constraints are not illustrated in the drawing.

Continuing now, left hand grip base 388 may include a downwardly extending extension member 389. A swing arm 380 may be rotatably secured to the extension 389 of the left hand grip base 388. A first pair of lugs 351 and 352 spaced apart from on another may be fixedly secured to the left span of the cable 370 and a second pair of lugs 353 and 354 spaced apart from on another may be fixedly secured to the right span of the cable 370. The first pair of lugs 351, 352 define a first gap 355 therebetween and the second pair of lugs 353, 354 define a second gap 357 therebetween.

During operation, the two coordinated body movements mentioned above are generally possible. First, an ipsilateral movement occurs when the user has rotated the swing arm 380 into the gap 355 between lugs 351 and 352 as shown in FIG. 8A. A contralateral movement occurs when an upper limb and an opposite lower limb of a user move in the same direction. A contralateral movement may be initiated upon rotating the swing arm 380 into the gap 357 between lugs 353 and 354 as shown in FIG. 8B.

A roller chain embodiment may alternatively be employed in substitution for the endless foot cable loop 370 and/or the endless hand cable loop 375. In this instance rather than utilize lugs 351, 352, 353, and 354, roller chain side links may include protrusions at given links which allow engagement of the swing arm 380 with or between selected link protrusions when choosing either the straight or cross climbing mode. In this example, any of the pulleys 330, 335, 338, and 339 may consist of roller chain sprockets. Similarly, belts being either smooth or synchronous may alternatively be employed while substituting the pulleys 330, 335, 338, and 339 with appropriate pulley hardware.

While a preferred embodiments of the invention has been shown and described, other and further embodiments of the invention may be devised without departing from the basic scope thereof, and the scope thereof is determined by the claims which follow.

The invention claimed is:

1. An exercise apparatus, comprising:

a) a frame;

b) a first pair of pulleys and a second pair of pulleys are rotatably connected to said frame, said first pair of pulleys and said second pair of pulleys each including an upper pulley vertically spaced from a lower pulley;

c) a first endless belt routed about said first pair of pulleys and a second endless belt routed about said second pair of pulleys;

d) a first pair of carriage members and a second pair of carriage members coupled to said first endless belt and said second endless belt, respectively;

e) a rack pin movably secured to each said first and second pair of carriage members; and f) a pinion gear rotatably supported by each said first and second pair of carriage members, said pinion gear actuable to move said rack pin for selectively coupling said first and second pair of carriage members to respective said first endless belt and said second endless belt.

2. The exercise apparatus of claim 1 further including a handlebar and a foot support member connected to respective said first and second pair of carriage members.

3. The exercise apparatus of claim 1 wherein each carriage member of said first and second pair of carriage members includes a carriage chassis and further including rollers rotatably secured to each said carriage member.

4. The exercise apparatus of claim 1 further including a transverse cross shaft rotatably coupled to said frame, right and left timing pulleys rigidly secured proximate to opposite distal ends of said transverse cross shaft, said right and left timing pulleys engaging each said first and second endless belt, respectively.

5. The exercise apparatus of claim 4 further including a resistance unit coupled to said transverse cross shaft.

6. The exercise apparatus of claim 5 wherein said resistance unit includes mechanical friction resistance or magnetic resistance.

7. The exercise apparatus of claim 1 wherein said pinion gear is fixedly secured to a distal end of a pinion shaft, and further including a knob fixedly secured to an opposite distal end of said pinion shaft, wherein rotation of said knob translates to lateral movement of said rack pin.

8. The exercise apparatus of claim 1 further including a first clamp and a second clamp fixedly secured to opposite sides of each said first pair of carriage members and said second pair of carriage members, said first clamp configured to connect to a first span of said first endless belt and said second endless belt, respectively, and said second clamp configured to connect to a second span of said first endless belt and said second endless belt, respectively.

9. An exercise apparatus, comprising:

a) a frame;

b) a first endless belt rotatably secured to said frame;

c) a second endless belt rotatably secured to said frame; and d) a pair of hand grip carriage members secured to said first endless belt, and a pair of foot support carriage members secured to said second endless belt;

e) wherein said first pair of hand grip carriage members include a right hand grip secured to a right span of said first endless belt and a left hand grip secured to a left span of said first endless belt, and said pair of foot support carriage members include right and left foot platforms fixedly secured to respective right and left spans of said second endless belt; and f) wherein said left hand grip includes a swing arm selectively engageable with a respective said right and left spans of said second endless belt.

10. The exercise apparatus of claim 9 further including a first pair of stop members fixedly secured to said left span of said second endless belt and a second pair of stop members fixedly secured to said right span of said second endless belt, said first pair of stop members and said second pair of stop members spaced apart from one another defining a first gap and a second gap therebetween, respectively.

11. The exercise apparatus of claim 10 wherein said left hand grip includes a swing arm selectively engageable with said first pair of stop members and said second pair of stop members, respectively.

* * * * *